US011299955B2

(12) United States Patent
Fripp et al.

(10) Patent No.: US 11,299,955 B2
(45) Date of Patent: Apr. 12, 2022

(54) SWELLABLE METAL FOR SWELL PACKER

(71) Applicant: Halliburton Energy Services, Inc., Houston, TX (US)

(72) Inventors: Michael L. Fripp, Carrollton, TX (US); Zachary W. Walton, Carrollton, TX (US); Pete C. Dagenais, The Colony, TX (US); Stephen M. Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 281 days.

(21) Appl. No.: 16/485,737

(22) PCT Filed: Feb. 23, 2018

(86) PCT No.: PCT/US2018/019337
§ 371 (c)(1),
(2) Date: Aug. 13, 2019

(87) PCT Pub. No.: WO2019/164499
PCT Pub. Date: Aug. 29, 2019

(65) Prior Publication Data
US 2021/0332659 A1 Oct. 28, 2021

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

| | | | |
|---|---|---|---|
| 3,046,601 | A | 7/1962 | Hubbert et al. |
| 4,445,694 | A | 5/1984 | Flaherty |
| 4,612,985 | A | 9/1986 | Rubbo et al. |
| 4,846,278 | A | 7/1989 | Robbins |
| 6,098,717 | A | 8/2000 | Bailey et al. |
| 6,640,893 | B1 | 11/2003 | Rummel et al. |
| 6,695,061 | B2 | 2/2004 | Fripp et al. |
| 7,040,404 | B2 | 5/2006 | Brothers et al. |
| 7,543,639 | B2 | 6/2009 | Emerson |

(Continued)

FOREIGN PATENT DOCUMENTS

| | | | |
|---|---|---|---|
| CA | 8085547 | A1 | 8/2019 |
| CN | 1708631 | A | 12/2005 |

(Continued)

OTHER PUBLICATIONS

International Search Report and Written Opinion dated Nov. 19, 2018; International PCT Application No. PCT/US2018/019337.

(Continued)

*Primary Examiner* — Steven A MacDonald
(74) *Attorney, Agent, or Firm* — McGuireWoods LLP

(57) ABSTRACT

Swell packers comprising swellable metal sealing elements and methods for forming a seal in a wellbore are provided. An example method includes providing a swell packer comprising a swellable metal sealing element; wherein the swell packer is disposed on a conduit in the wellbore, exposing the swellable metal sealing element to a brine, and allowing or causing to allow the swellable metal sealing element to swell.

20 Claims, 8 Drawing Sheets

(56) References Cited

U.S. PATENT DOCUMENTS 7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,133,683 B2 9/2015 Dyer et al.
9,404,030 B2 * 8/2016 Mazyar ..... C09K 8/50
9,518,453 B2 12/2016 Dilber et al.
9,725,979 B2 * 8/2017 Mazyar ..... E21B 33/1208
9,745,451 B2 8/2017 Zhao et al.
9,856,710 B2 1/2018 Zhu et al.
9,869,152 B2 1/2018 Gamstedt et al.
10,119,011 B2 11/2018 Zhao et al.
10,851,615 B2 12/2020 Watson et al.
10,961,804 B1 3/2021 Fripp et al.
2003/0150614 A1 8/2003 Brown et al.
2004/0149418 A1 8/2004 Bosma et al.
2005/0092485 A1 * 5/2005 Brezinski ..... E21B 33/12 166/207
2005/0171248 A1 8/2005 Li et al.
2005/0199401 A1 9/2005 Patel et al.
2006/0175065 A1 8/2006 Ross
2007/0089911 A1 4/2007 Moyes
2007/0095532 A1 5/2007 Head et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1 * 6/2008 Marya ..... E21B 23/00 166/387
2008/0185158 A1 * 8/2008 Chalker ..... E21B 33/13 166/387
2008/0220991 A1 * 9/2008 Slay ..... E21B 33/1208 507/203
2009/0020286 A1 1/2009 Johnson
2009/0084550 A1 * 4/2009 Korte ..... C08L 1/284 166/294
2009/0179383 A1 7/2009 Koloy et al.
2009/0188569 A1 7/2009 Saltel
2009/0242189 A1 10/2009 Vaidya et al.
2009/0242214 A1 * 10/2009 Foster ..... E21B 23/01 166/387
2009/0272546 A1 11/2009 Nutley et al.
2009/0277652 A1 11/2009 Nutley et al.
2010/0038074 A1 * 2/2010 Patel ..... E21B 33/1216 166/187
2010/0163252 A1 7/2010 Regnault De La Mothe et al.
2010/0270031 A1 10/2010 Patel
2011/0073310 A1 3/2011 Clemens
2011/0098202 A1 * 4/2011 James ..... C04B 26/02 507/225
2011/0226374 A1 9/2011 Kalman
2011/0253393 A1 10/2011 Vaidya et al.
2012/0048551 A1 * 3/2012 Allison ..... E21B 33/1208 166/292
2012/0073834 A1 3/2012 Lembcke
2012/0132427 A1 5/2012 Renshaw et al.
2012/0175134 A1 7/2012 Robisson et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2013/0056196 A1 3/2013 Hench
2013/0056227 A1 3/2013 Sponchia
2013/0146312 A1 * 6/2013 Gerrard ..... C09K 8/512 166/387
2014/0051612 A1 * 2/2014 Mazyar ..... E21B 33/1208 507/269
2014/0054047 A1 2/2014 Zhou
2014/0060815 A1 3/2014 Wang et al.
2014/0238692 A1 8/2014 Watson
2014/0251641 A1 9/2014 Marya et al.
2014/0262351 A1 9/2014 Derby
2014/0361497 A1 12/2014 Porta
2015/0060063 A1 * 3/2015 Miller ..... E21B 43/26 166/279
2015/0060064 A1 * 3/2015 Lafferty ..... E21B 43/267 166/280.1
2015/0101813 A1 4/2015 Zhao et al.
2015/0199401 A1 7/2015 Polehn et al.
2015/0267501 A1 9/2015 Al-Gouhi
2015/0275644 A1 * 10/2015 Chen ..... C09K 8/80 166/308.1
2015/0308214 A1 10/2015 Bilansky et al.
2015/0344772 A1 * 12/2015 Droger ..... E21B 43/267 166/280.1
2015/0369027 A1 * 12/2015 Jones ..... E21B 43/267 166/280.2
2016/0032696 A1 2/2016 Caccialupi et al.
2016/0137912 A1 5/2016 Sherman et al.
2016/0138359 A1 * 5/2016 Zhao ..... E21B 33/1208 277/316
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 * 8/2016 Mazyar ..... C09K 8/03
2016/0319633 A1 11/2016 Cooper et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2018/0078998 A1 3/2018 Sherman
2018/0087346 A1 3/2018 Rochen
2018/0087350 A1 * 3/2018 Sherman ..... E21B 43/086
2018/0266215 A1 9/2018 Fagley, IV et al.
2018/0355691 A1 12/2018 Andersen
2018/0355693 A1 12/2018 Al-AbdulJabbar et al.
2019/0055839 A1 2/2019 Skillingstad et al.
2019/0203101 A1 7/2019 Dusterhoft et al.
2019/0249509 A1 8/2019 Jakkula et al.
2020/0240235 A1 7/2020 Fripp et al.
2020/0325749 A1 10/2020 Fripp et al.
2020/0370391 A1 11/2020 Fripp et al.

FOREIGN PATENT DOCUMENTS

CN 102027189 A 4/2011
CN 107148444 A 9/2017
CN 107532466 A 1/2018
EP 2217790 B1 10/2016
EP 2753791 B1 6/2017
GB 2416796 A 2/2008
GB 2469723 A 10/2010
GB 2514195 B 6/2019
GB 2583232 A 10/2020
WO 2008079486 A1 7/2008
WO 2014210283 A1 12/2014
WO 2016171666 A1 10/2016
WO 2018005740 A1 1/2018
WO 2018057361 A1 3/2018
WO 2018147833 A1 8/2018
WO 2019094044 A1 5/2019
WO 2019147285 A1 8/2019
WO 2019164492 A1 8/2019
WO 2019164499 A1 8/2019
WO 2020005252 A1 1/2020
WO 2020018110 A1 1/2020

OTHER PUBLICATIONS

Denmark Examination Report and Search Report dated Mar. 16, 2021, Denmark Application No. PA202070389.

(56) References Cited

OTHER PUBLICATIONS

International Search Report and Written Opinion dated Jul. 8, 2020, issued in related International Application No. PCT/US2019/056814.
International Search Report and Written Opinion dated Aug. 2, 2018, International PCT Application No. PCT/US2017/061307.
Search Report in FR Application No. 1859379, dated Oct. 15, 2019.
International Search Report and Written Opinion for corresponding PCT International Application No. PCT/US2019/068497; dated Sep. 17, 2020.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
Nemisis Annulus Swellable Packer, Weatherford, Swellable Products, 2009-2011.
International Search Report and Written Opinion dated Nov. 22, 2019; International PCT Application No. PCT/US2019/019210.
International Search Report and Witten Opinion dated May 20, 2020, issued in related PCT/US2019/047529.
Tao, Solid expandable tubular patching technique for high-temperature and high-pressure casing damaged wells, Research Paper, Jun. 2015, pp. 408-409, Petroleum Exploration and Development, vol. 42, Issue 8.
Dutch Search Report issued in NL 2026726, dated Aug. 13, 2021.
International Search Report and Written Opinion dated Sep. 8, 2021 in PCT/US2020/066193.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report dated Dec. 17, 2021; CN Application No. 2018800875885.
Examination Report in GB Appln No. 2010931.0 dated Jan. 18, 2022.

* cited by examiner

SWELLABLE METAL FOR SWELL PACKER

TECHNICAL FIELD

The present disclosure relates to the use of swellable metals for use with swell packers, and more particularly, to the use of swellable metals as non-elastomeric swellable materials for swell packers used to form annular seals in a wellbore.

BACKGROUND

Swell packers may be used, among other reasons, for forming annular seals in and around conduits in wellbore environments. The swell packers expand over time if contacted with specific swell-inducing fluids. The swell packers comprise swellable materials that may swell to form an annular seal in the annulus around the conduit. Swell packers may be used to form these annular seals in both open and cased wellbores. This seal may restrict all or a portion of fluid and/or pressure communication at the seal interface. Forming seals may be an important part of wellbore operations at all stages of drilling, completion, and production.

Swell packers are typically used for zonal isolation whereby a zone or zones of a subterranean formation may be isolated from other zones of the subterranean formation and/or other subterranean formations. One specific use of swell packers is to isolate any of a variety of inflow control devices, screens, or other such downhole tools, that are typically used in flowing wells.

Many species of swellable materials used for sealing comprise elastomers. Elastomers, such as rubber, may degrade in high-salinity and/or high-temperature environments. Further, elastomers may lose resiliency over time resulting in failure and/or necessitating repeated replacement. Some sealing materials may also require precision machining to ensure that surface contact at the interface of the sealing element is optimized. As such, materials that do not have a good surface finish, for example, rough or irregular surfaces having gaps, bumps, or any other profile variance, may not be sufficiently sealed by these materials. One specific example of such a material is the wall of the wellbore. The wellbore wall may comprise a variety of profile variances and is generally not a smooth surface upon which a seal may be made easily.

If a swell packer fails, for example, due to degradation of the swellable material from high salinity and/or high temperature environments, wellbore operations may have to be halted, resulting in a loss of productive time and the need for additional expenditure to mitigate damage and correct the failed swell packer. Alternatively, there may be a loss of isolation between zones that may result in reduced recovery efficiency or premature water and/or gas breakthrough.

BRIEF DESCRIPTION OF THE DRAWINGS

Illustrative examples of the present disclosure are described in detail below with reference to the attached drawing figures, which are incorporated by reference herein, and wherein.

Figure 1:
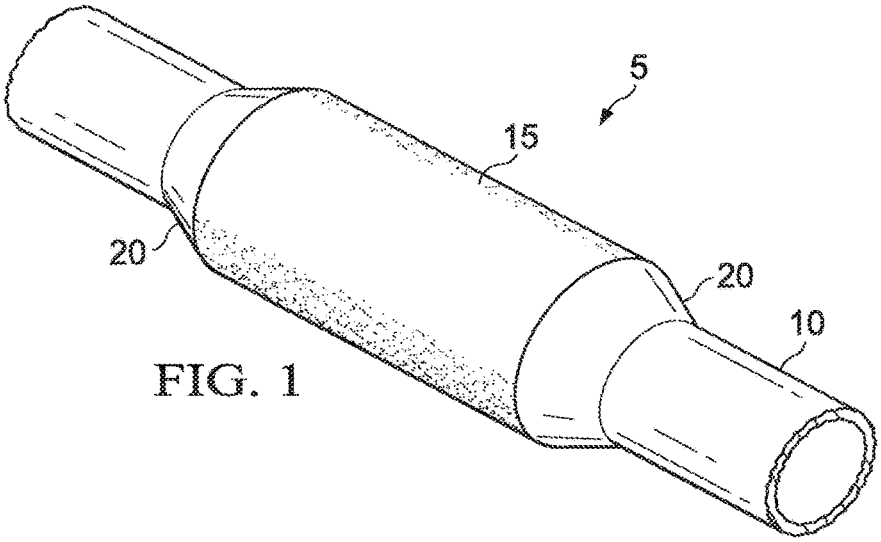
FIG. 1 is an isometric illustration of an example swell packer disposed on a conduit in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to the use of swellable metals for use with swell packers, and more particularly, to the use of swellable metals as non-elastomeric swellable materials for swell packers used to form annular seals in a wellbore.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Examples of the methods and systems described herein relate to the use of non-elastomeric sealing elements comprising swellable metals. As used herein, "sealing elements" refers to any element used to form a seal. The swellable metals may swell in brines and create a seal at the interface of the sealing element and adjacent surfaces. By "swell," "swelling," or "swellable" it is meant that the swellable metal increases its volume. Advantageously, the non-elastomeric sealing elements may be used on surfaces with profile variances, e.g., roughly finished surfaces, corroded surfaces, 3-D printed parts, etc. An example of a surface that may have a profile variance is a wellbore wall. Yet a further advantage is that the swellable metals may swell in high-salinity and/or high-temperature environments where the use of elastomeric materials, such as rubber, can perform poorly. The swellable metals comprise a wide variety of metals and metal alloys and may swell by the formation of metal hydroxides. The swellable metal sealing elements may be used as replacements for other types of sealing elements (i.e. non-swellable metal sealing elements, elastomeric sealing elements, etc.) in downhole tools, or they may be used as backups for other types of sealing elements in downhole tools.

The swellable metals swell by undergoing metal hydration reactions in the presence of brines to form metal hydroxides. The metal hydroxide occupies more space than the base metal reactant. This expansion in volume allows the swellable metal to form a seal at the interface of the swellable metal and any adjacent surfaces. For example, a mole of magnesium has a molar mass of 24 g/mol and a density of 1.74 g/cm$^3$ which results in a volume of 13.8 cm$^3$/mol. Magnesium hydroxide has a molar mass of 60 g/mol and a density of 2.34 g/cm$^3$ which results in a volume of 25.6 cm$^3$/mol. 25.6 cm$^3$/mol is 85% more volume than 13.8 cm$^3$/mol. As another example, a mole of calcium has a molar mass of 40 g/mol and a density of 1.54 g/cm$^3$ which results in a volume of 26.0 cm$^3$/mol. Calcium hydroxide has a molar mass of 76 g/mol and a density of 2.21 g/cm$^3$ which results in a volume of 34.4 cm$^3$/mol. 34.4 cm$^3$/mol is 32% more volume than 26.0 cm$^3$/mol. As yet another example, a mole of aluminum has a molar mass of 27 g/mol and a density of 2.7 g/cm$^3$ which results in a volume of 10.0 cm$^3$/mol. Aluminum hydroxide has a molar mass of 63 g/mol and a density of 2.42 g/cm$^3$ which results in a volume of 26 cm$^3$/mol. 26 cm$^3$/mol is 160% more volume than 10 cm$^3$/mol. The swellable metal comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metal.

Examples of suitable metals for the swellable metal include, but are not limited to, magnesium, calcium, aluminum, tin, zinc, beryllium, barium, manganese, or any combination thereof. Preferred metals include magnesium, calcium, and aluminum.

Examples of suitable metal alloys for the swellable metal include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increased hydroxide formation. Examples of dopant metals include, but are not limited to nickel, iron, copper, carbon, titanium, gallium, mercury, cobalt, iridium, gold, palladium, or any combination thereof.

In examples where the swellable metal comprises a metal alloy, the metal alloy may be produced from a solid solution process or a powder metallurgical process. The sealing element comprising the metal alloy may be formed either from the metal alloy production process or through subsequent processing of the metal alloy.

As used herein, the term "solid solution" refers to an alloy that is formed from a single melt where all of the components in the alloy (e.g., a magnesium alloy) are melted together in a casting. The casting can be subsequently extruded, wrought, hipped, or worked to form the desired shape for the sealing element of the swellable metal. Preferably, the alloying components are uniformly distributed throughout the metal alloy, although intra-granular inclusions may be present, without departing from the scope of the present disclosure. It is to be understood that some minor variations in the distribution of the alloying particles can occur, but it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase.

A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metal.

In some alternative examples, the swellable metal comprises an oxide. As an example, calcium oxide reacts with water in an energetic reaction to produce calcium hydroxide. 1 mole of calcium oxide occupies 9.5 cm$^3$ whereas 1 mole of calcium hydroxide occupies 34.4 cm$^3$ which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

It is to be understood, that the selected swellable metal is to be selected such that the formed sealing element does not degrade into the brine. As such, the use of metals or metal alloys for the swellable metal that form relatively waterinsoluble hydration products may be preferred. For example, magnesium hydroxide and calcium hydroxide have low solubility in water. Alternatively, or in addition to, the sealing element may be positioned in the downhole tool such that degradation into the brine is constrained due to the geometry of the area in which the sealing element is disposed and thus resulting in reduced exposure of the sealing element. For example, the volume of the area in which the sealing element is disposed is less than the expansion volume of the swellable metal. In some examples, the volume of the area is less than as much as 50% of the expansion volume. Alternatively, the volume of the area in which the sealing element may be disposed may be less than 90% of the expansion volume, less than 80% of the expansion volume, less than 70% of the expansion volume, or less than 60% of the expansion volume.

In some examples, the metal hydration reaction may comprise an intermediate step where the metal hydroxides are small particles. When confined, these small particles may lock together to create the seal. Thus, there may be an intermediate step where the swellable metal forms a series of fine particles between the steps of being solid metal and forming a seal. The small particles have a maximum dimension less than 0.1 inch and generally have a maximum dimension less than 0.01 inches. In some embodiments, the small particles comprise between one and 100 grains (metallurgical grains).

In some alternative examples, the swellable metal is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluroelastomers, ethylene-based rubber, and PEEK. In some embodiments, the dispersed swellable metal may be cuttings obtained from a machining process.

In some examples, the metal hydroxide formed from the swellable metal may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metal. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metal may allow the swellable metal to form additional metal hydroxide and continue to swell.

The swellable metal sealing elements may be used to form a seal at the interface of the sealing element and an adjacent surface having profile variances, a rough finish, etc. These surfaces are not smooth, even, and/or consistent at the area where the sealing is to occur. These surfaces may have any type of indentation or projection, for example, gashes, gaps, pocks, pits, holes, divots, and the like. An example of a surface that may comprise these indentations or projections is the wellbore wall such as a casing wall or the wall of the formation. The wellbore wall may not be a smooth surface and may comprise various irregularities that require the sealing element to be adaptive in order to provide a sufficient seal. Additionally, components produced by additive manufacturing, for example 3-D printed components, may be used with the sealing elements to form seals. Additive manufactured components may not involve precision machining and may, in some examples, comprise a rough surface finish. In some examples, the components may not be machined and may just comprise the cast finish. The sealing elements may expand to fill and seal the imperfect areas of these adjacent areas allowing a seal to be formed between surfaces that may be difficult to seal otherwise. Advantageously, the sealing elements may also be used to form a seal at the interface of the sealing element and an irregular surface component. For example, components manufactured in segments or split with scarf joints, butt joints, splice joints, etc. may be sealed, and the hydration process of the swellable metals may be used to close the gaps in the irregular surface. As such, the swellable metal sealing elements may be viable sealing options for difficult to seal surfaces.

The swellable metal sealing elements may be used to form a seal between any adjacent surfaces in the wellbore between and/or on which the swell packer may be disposed. Without limitation, the swell packer may be used to form seals on conduits, formation surfaces, cement sheaths, downhole tools, and the like. For example, a swell packer may be used to form a seal between the outer diameter of a conduit and a surface of the subterranean formation. Alternatively, a swell packer may be used to form a seal between the outer diameter of a conduit and a cement sheath (e.g., a casing). As another example, a swell packer may be used to form a seal between the outer diameter of one conduit and the inner diameter of another conduit (which may be the same or different). Moreover, a plurality of swell packers may be used to form seals between multiple strings of conduits (e.g., oilfield tubulars). In one specific example, a swell packer may form a seal on the inner diameter of a conduit to restrict fluid flow through the inner diameter of a conduit, thus functioning similarly to a bridge plug. It is to be understood that the swell packer may be used to form a seal between any adjacent surfaces in the wellbore and the disclosure is not to be limited to the explicit examples disclosed herein.

As described above, the swellable metal sealing elements are produced from swellable metals and as such, are non-elastomeric materials except for the specific examples that further comprise an elastomeric binder for the swellable metals. As non-elastomeric materials, the swellable metal sealing elements do not possess elasticity, and therefore, they irreversibly swell when contacted with a brine. The swellable metal sealing elements do not return to their original size or shape even after the brine is removed from contact. In examples comprising an elastomeric binder, the elastomeric binder may return to its original size or shape; however, any swellable metal dispersed therein would not.

The brine may be saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%. In said examples, use of elastomeric sealing elements may be impacted. Advantageously, the swellable metal sealing elements of the present disclosure are not impacted by contact with high-salinity brines. One of ordinary skill in the art, with the benefit of this disclosure, should be readily able to select a brine for a chosen application.

The sealing elements may be used in high-temperature formations, for example, in formations with zones having temperatures equal to or exceeding 350° F. In these high-temperature formations, use of elastomeric sealing elements may be impacted. Advantageously, the swellable metal sealing elements of the present disclosure are not impacted by use in high-temperature formations. In some examples, the sealing elements of the present disclosure may be used in both high-temperature formations and with high-salinity brines. In a specific example, a swellable metal sealing element may be positioned on a swell packer and used to form a seal by swelling after contact with a brine having a salinity of 10% or greater and also while being disposed in a wellbore zone having a temperature equal to or exceeding 350° F.

FIG. 1 is an isometric illustration of an example of a swell packer, generally 5, disposed on a conduit 10. The swell packer 5 comprises a swellable metal sealing element 15 as disclosed and described herein. The swell packer 5 is wrapped or slipped on the conduit 10 with weight, grade, and connection specified by the well design. The conduit 10 may be any type of conduit used in a wellbore, including drill pipe, stick pipe, tubing, coiled tubing, etc. The swell packer 5 further comprises end rings 20. End rings 20 protect the swellable metal sealing element 15 as it is run to depth. End rings 20 may create an extrusion barrier, preventing the applied pressure from extruding the seal formed from the swellable metal sealing element 15 in the direction of said applied pressure. In some examples, end rings 20 may comprise a swellable metal and may thus serve a dual function as a swellable metal sealing element analogously to swellable metal sealing element 15. In some examples, end rings 20 may not comprise a swellable metal or any swellable material. Although FIG. 1 and some other examples illustrated herein may illustrate end rings 20 as a component of swell packer 5 or other examples of swell packers, it is to be understood that end rings 20 are optional components in all examples described herein, and are not necessary for any swell packer described herein to function as intended.

When exposed to a brine, the swellable metal sealing element 15 may swell and form an annular seal at the interface of an adjacent wellbore wall as described above. In alternative examples, the annular seal may be at the interface of the conduit and a casing, downhole tool, or another conduit. This swelling is achieved by the swellable metal increasing in volume. This increase in volume corresponds to an increase in the swell packer 5 diameter. The swellable metal sealing element 15 may continue to swell until contact with the wellbore wall is made. In alternative examples, the swellable metal sealing element 15 may comprise a binder with a swellable metal dispersed therein as described above. The binder may be any binder disclosed herein.

Figure 2:
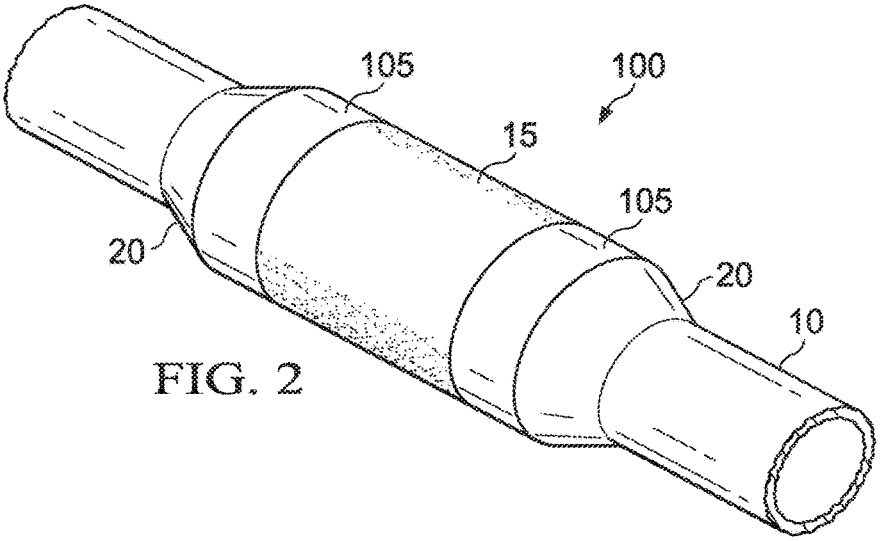
FIG. 2 is an isometric illustration of another example swell packer disposed on a conduit in accordance with the examples disclosed herein.

FIG. 2 is an isometric illustration of another example of a swell packer, generally 100, disposed on the conduit 10 as described in FIG. 1. The swell packer 100 comprises the swellable metal sealing element 15 as described in FIG. 1. The swell packer 100 is wrapped or slipped on the conduit 10 with weight, grade, and connection specified by the well design. The swell packer 100 further comprises optional end rings 20 as described in FIG. 1. Swell packer 100 further comprises two swellable non-metal sealing elements 105 disposed adjacent to end rings 20 and the swellable metal sealing element 15.

Swellable non-metal sealing elements 105 may comprise any oil-swellable, water-swellable, and/or combination swellable non-metal material as would occur to one of ordinary skill in the art. A specific example of a swellable non-metal material is a swellable elastomer. The swellable non-metal sealing elements 105 may swell when exposed to a fluid that induces swelling (e.g., an oleaginous or aqueous fluid). Generally, the swellable non-metal sealing elements 105 may swell through diffusion whereby the swelling-inducing fluid is absorbed into the swellable non-metal sealing elements 105. This fluid may continue to diffuse into the swellable non-metal sealing elements 105 causing the swellable non-metal sealing elements 105 to swell until they contact the adjacent wellbore wall, working in tandem with the swellable metal sealing element 15 to create a differential annular seal.

Although FIG. 2 illustrates two swellable non-metal sealing elements 105, it is to be understood that in some examples only one swellable non-metal sealing element 105 may be provided, and the swellable metal sealing element 15 may be disposed adjacent to an end ring 20, or, alternatively, may comprise the end of the swell packer 100 should end rings 20 not be provided.

Further, although FIG. 2 illustrates two swellable non-metal sealing elements 105 individually adjacent to one end of the swellable metal sealing element 15, it is to be understood that in some examples, the orientation may be reversed and the swell packer 100 may instead comprise two swellable metal sealing elements 15 each individually disposed adjacent to an end ring 20 and also one end of the swellable non-metal sealing element 105.

Figure 3:
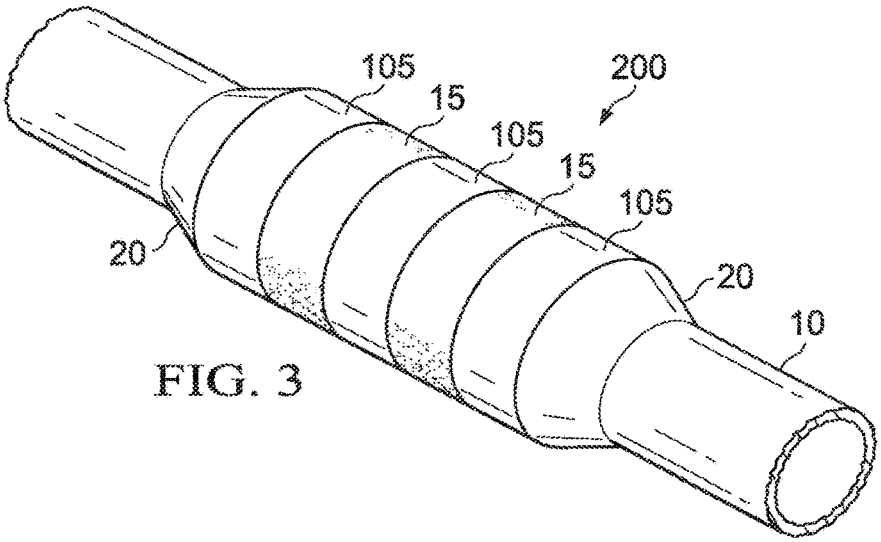
FIG. 3 is an isometric illustration of yet another example swell packer disposed on a conduit in accordance with the examples disclosed herein.

FIG. 3 is an isometric illustration of another example of a swell packer, generally 200, disposed on the conduit 10 as described in FIG. 1 as conduit 10 is run in hole. The swell packer 200 comprises multiple swellable metal sealing elements 15 as described in FIG. 1 and also multiple swellable non-metal sealing elements 105 as described in FIG. 2. The swell packer 200 is wrapped or slipped on the conduit 10 with weight, grade, and connection specified by the well design. The swell packer 200 further comprises optional end rings 20 as described in FIG. 1. Swell packer 200 differs from swell packer 5 and swell packer 100 as described in FIGS. 1 and 2 respectively, in that swell packer 200 alternates swellable metal sealing elements 15 and swellable non-metal sealing elements 105. The swell packer 200 may comprise any multiple of swellable metal sealing elements 15 and swellable non-metal sealing elements 105 arranged in any pattern (e.g., alternating, as illustrated). The multiple swellable metal sealing elements 15 and swellable non-metal sealing elements 105 may swell as desired to create an annular seal as described above. In some examples, the swellable metal sealing elements 15 may comprise different types of swellable metals, allowing the swell packer 200 to be custom configured to the well as desired.

Figure 4:
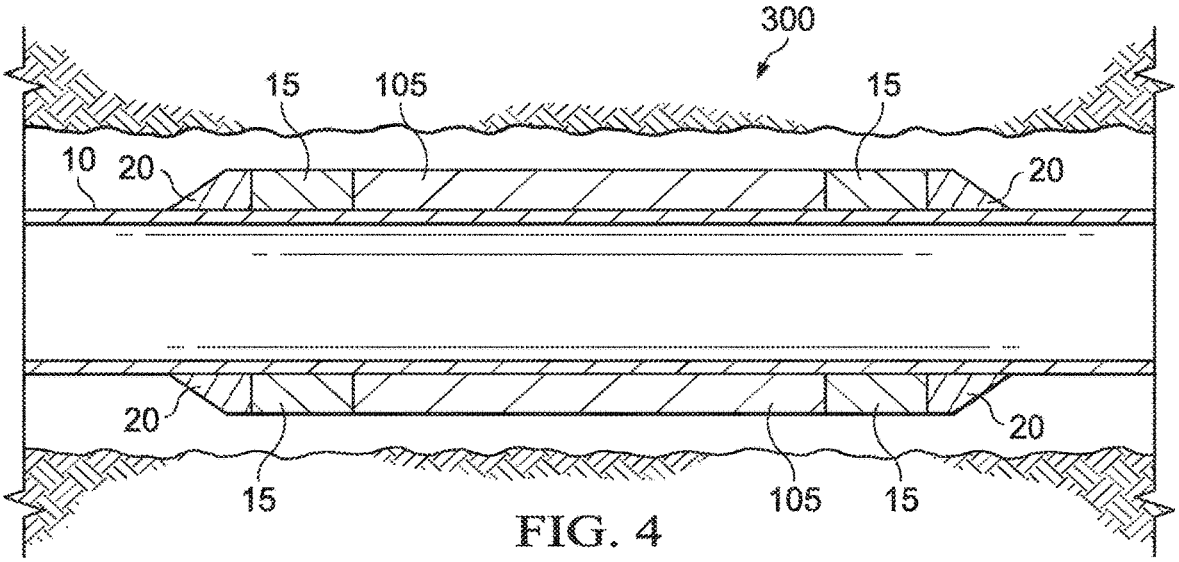
FIG. 4 is a cross-sectional illustration of another example swell packer disposed on a conduit in a wellbore in accordance with the examples disclosed herein.

FIG. 4 is a cross-section illustration of another example of a swell packer, generally 300, disposed on the conduit 10 as described in FIG. 1. As described above in the example of FIG. 2, the swell packer 300 comprises an alternative arrangement of multiple swellable metal sealing elements 15 and a swellable non-metal sealing element 105. In this example, swell packer 300 comprises two swellable metal sealing elements 15 individually disposed adjacent to both an end ring 20 and one end of the swellable non-metal sealing element 105. As illustrated, optional end rings 20 may protect the swell packer 300 from abrasion as it is run in hole.

Figure 5:
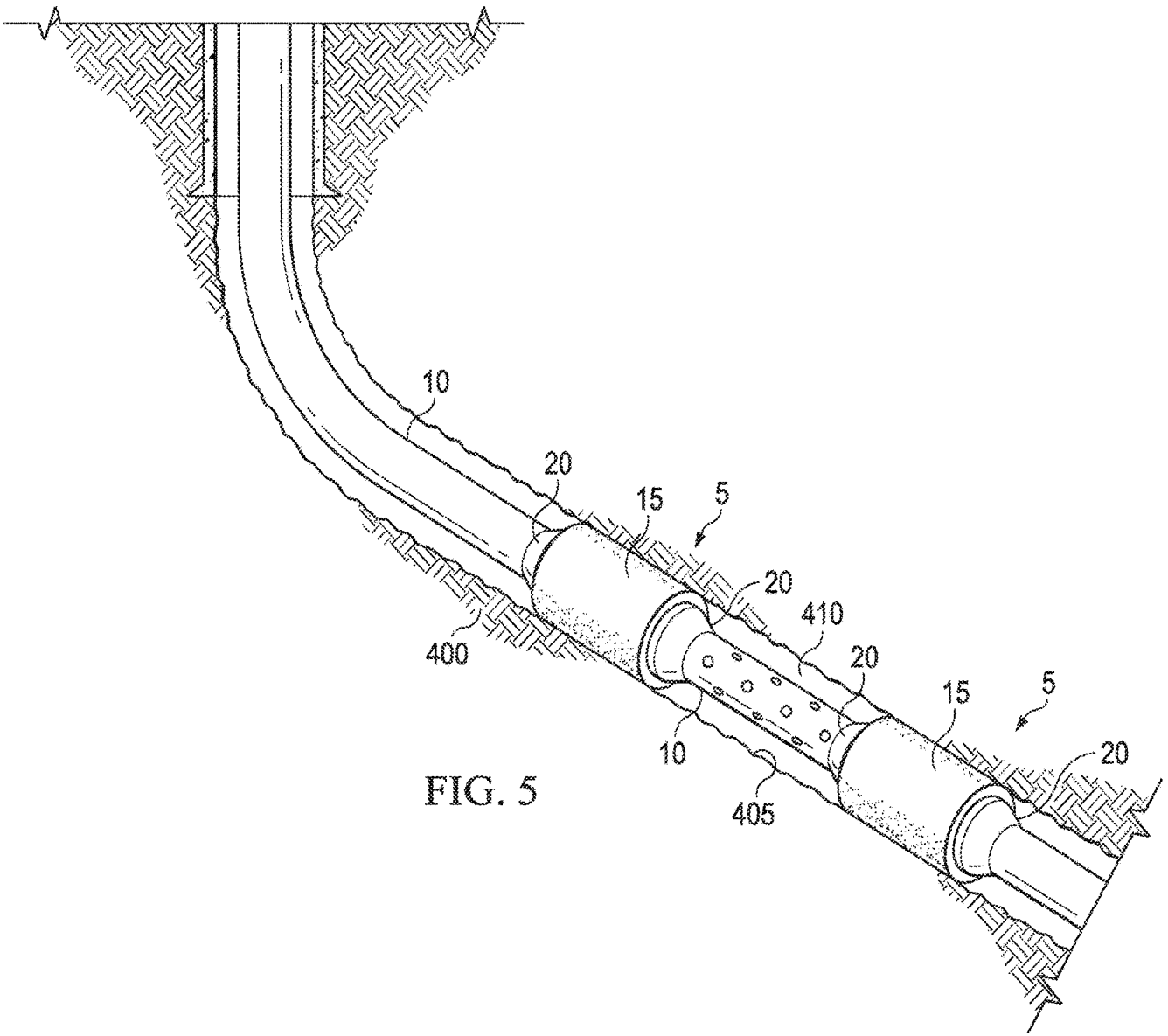
FIG. 5 is an isometric illustration of the swell packer of FIG. 1 disposed on a conduit in a wellbore and set at depth in accordance with the examples disclosed herein.

FIG. 5 illustrates swell packer 5 as described in FIG. 1, when run to a desired depth and set in a subterranean formation 400. At the desired setting depth swell packer 5 has been exposed to a brine, and the swellable metal sealing element 15 has swollen to contact the adjacent wellbore wall 405 to form an annular seal as illustrated. In the illustrated example, multiple swell packers 5 are illustrated. As the multiple swell packers 5 seal the wellbore, portions of wellbore 410 between said seals may be isolated from other portions of wellbore 410. Although the isolated portion of wellbore 410 is illustrated as uncased, it is to be understood that the swell packer 5 may be used in any cased portion of wellbore 410 to form an annular seal in the annulus between the conduit 10 and a cement sheath. Further, swell packer 5 may also be used to form an annular seal between two distinct conduits 10 in other examples. Finally, although FIG. 5 illustrates the use of swell packer 5, it is to be understood that any swell packer or combination of swell packers disclosed herein may be used in any of the examples disclosed herein.

Figure 6:
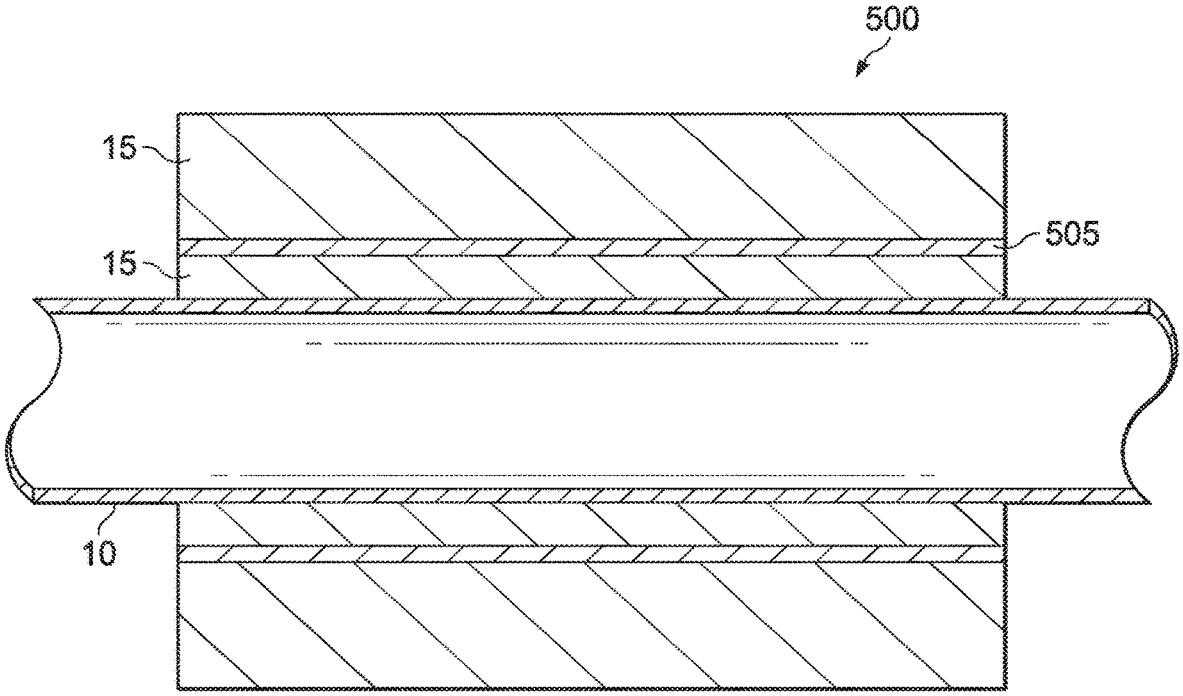
FIG. 6 illustrates a cross-sectional illustration of an additional example of swell packer disposed on a conduit in accordance with the examples disclosed herein.

FIG. 6 is a cross-section illustration of another example of a swell packer, generally 500, disposed on a conduit 10 as described in FIG. 1. The swell packer 500 comprises swellable metal sealing elements 15 as described in FIG. 1. The swell packer 500 further comprises a reinforcement layer 505. Reinforcement layer 505 may be disposed between two layers of swellable metal sealing elements 15 as illustrated. Reinforcement layer 505 may provide extrusion resistance to the swellable metal sealing elements 15, and may also provide additional strength to the structure of the swell packer 500 and increase the pressure holding capabilities of swell packer 500. Reinforcement layer 505 may comprise any sufficient material for reinforcement of the swell packer 500. An example of a reinforcement material is steel. Generally, reinforcement layer 505 will comprise a non-swellable material. Further, reinforcement layer 505 may be perforated or solid. Swell packer 500 is not illustrated with optional end rings (as described in FIG. 1 above). However, in some examples, swell packer 500 may comprise the optional end rings. In an alternative example, the swell packer 500 may comprise a layer of swellable metal sealing element 15 and a layer of swellable non-metal sealing element (e.g., swellable non-metal sealing elements 105 as illustrated in FIG. 2). In one specific example, the outer layer may be the swellable metal sealing element 15 and the inner layer may be the swellable non-metal sealing element. In another specific example, the outer layer may be the swellable non-metal sealing element and the inner layer may be the swellable metal sealing element 15.

Figure 7:
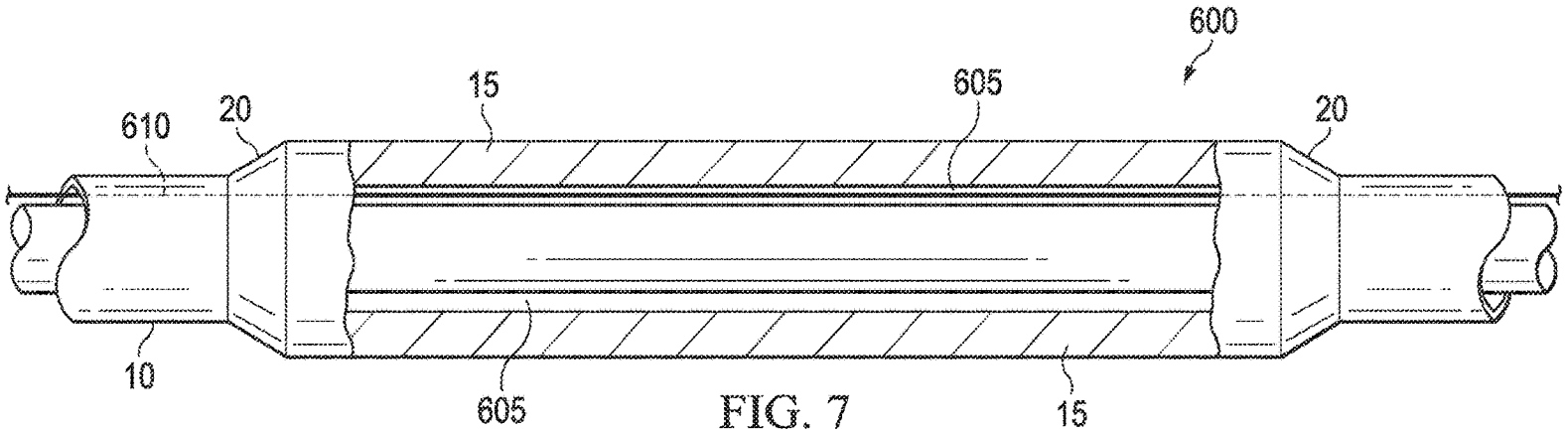
FIG. 7 illustrates a cross-sectional illustration of another additional example of swell packer disposed on a conduit in accordance with the examples disclosed herein.

FIG. 7 is an isometric illustration of another example of a swell packer, generally 600, disposed on a conduit 10 as described in FIG. 1. The swell packer 600 comprises at least two swellable metal sealing elements 15 as described in FIG. 1. The swell packer 600 is wrapped or slipped on the conduit 10 with weight, grade, and connection specified by the well design. The swell packer 600 further comprises optional end rings 20 as described in FIG. 1. In the example of swell packer 600, multiple swellable metal sealing elements 15 are illustrated. The swellable metal sealing elements 15 are arranged as strips or slats with gaps 605 disposed between the individual swellable metal sealing elements 15. Within the gaps 605, a line 610 may be run. Line 610 may be run from the surface and down the exterior of the conduit 10. Line 610 may be a control line, power line, hydraulic line, or more generally, a conveyance line that may convey power, data, instructions, pressure, fluids, etc. from the surface to a location within a wellbore. Line 610 may be used to power a downhole tool, control a downhole tool, provide instructions to a downhole tool, obtain wellbore environmental measurements, inject a fluid, etc. When swelling is induced in swellable metal sealing elements 15, the swellable metal sealing elements 15 may swell and close gaps 605 allowing an annular seal to be produced. The swellable metal sealing elements 15 may swell around any line 610 that may be present, and as such, line 610 may still function and successfully span the swell packer 600 even after setting.

Figure 8:
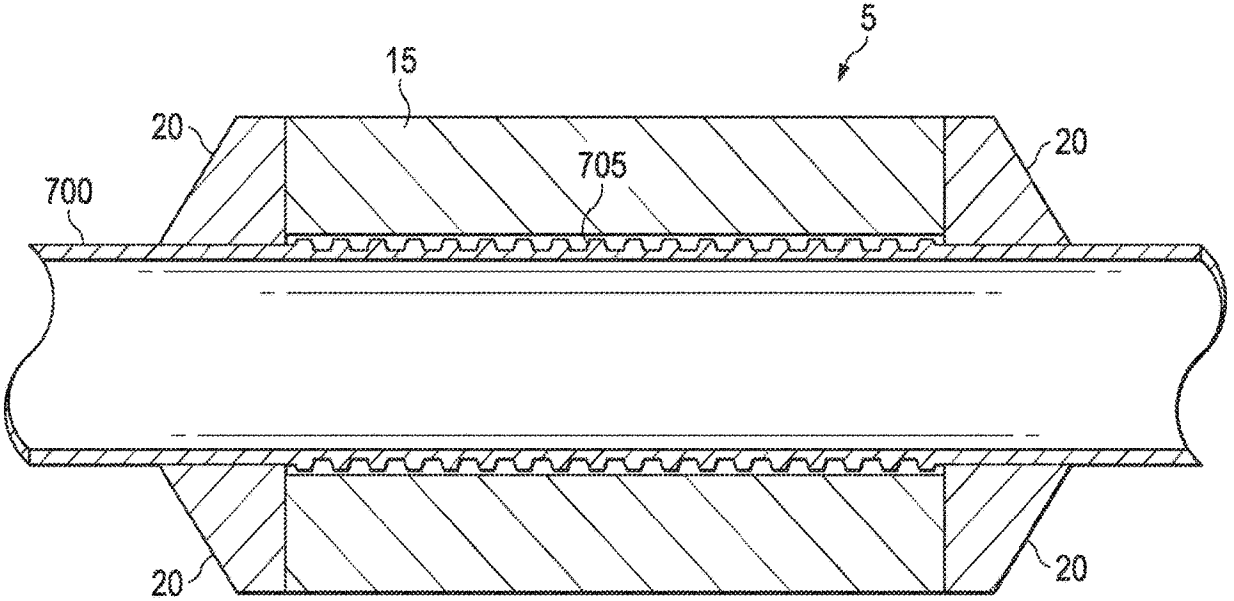
FIG. 8 illustrates a cross-sectional illustration of the swell packer of FIG. 1 disposed on a conduit comprising ridges in accordance with the examples disclosed herein.

FIG. 8 is a cross-section illustration of a swell packer 5 as described in FIG. 1 around a conduit 700. The swell packer 5 is wrapped or slipped on the conduit 700 with weight, grade, and connection specified by the well design. Conduit 700 comprises a profile variance, specifically, ridges 705 on a portion its exterior surface. Swell packer 5 is disposed over the ridges 705. As the swellable metal sealing element 15 swells, it may swell into the in-between spaces of the ridges 705 allowing the swellable metal sealing element 15 to be even further compressed when a differential pressure is applied. In addition to, or as a substitute for ridges 705, the profile variance on the exterior surface of the conduit 700 may comprise threads, tapering, slotted gaps, or any such variance allowing for the swellable metal sealing element 15 to swell within an interior space on the exterior surface of the conduit 700. Although FIG. 8 illustrates the use of swell packer 5, it is to be understood that any swell packer or combination of swell packers may be used in any of the examples disclosed herein.

Figure 9:
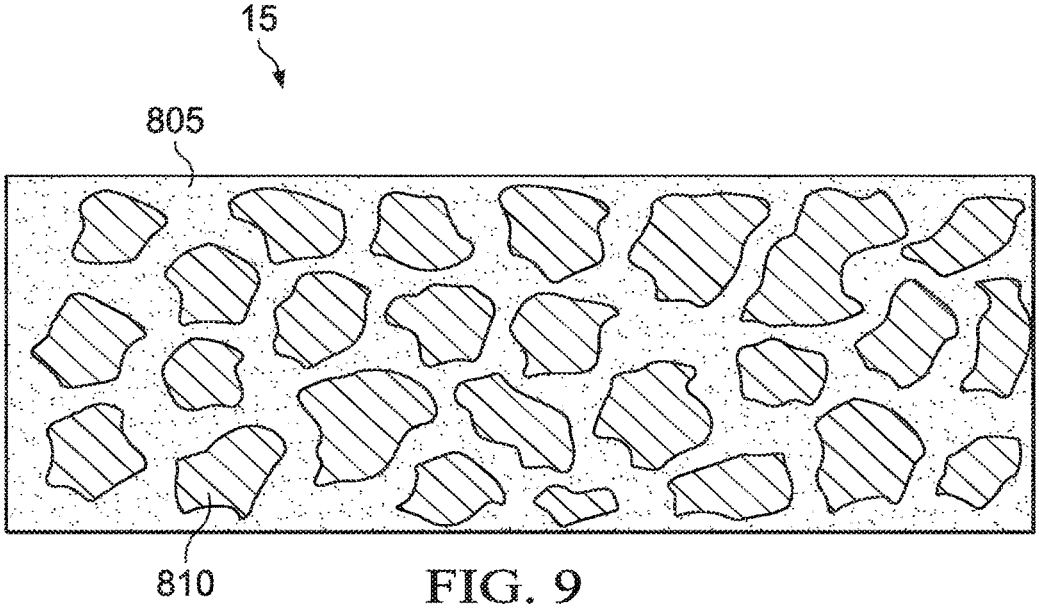
FIG. 9 is a cross-sectional illustration of a portion of a sealing element comprising a binder having a swellable metal dispersed therein in accordance with the examples disclosed herein.

FIG. 9 is a cross-sectional illustration of a portion of a swellable metal sealing element 15 and used as described above. This specific swellable metal sealing element 15 comprises a binder 805 and has the swellable metal 810 dispersed therein. As illustrated, the swellable metal 810 may be distributed within the binder 805. The distribution may be homogenous or non-homogenous. The swellable metal 810 may be distributed within the binder 805 using any suitable method. Binder 805 may be any binder material as described herein. Binder 805 may be non-swelling, oil-swellable, water-swellable, or oil- and water-swellable. Binder 805 may be degradable. Binder 805 may be porous or non-porous. The swellable metal sealing element 15 comprising binder 805 and having a swellable metal 810 dispersed therein may be used in any of the examples described herein and depicted in any of the FIGURES. In one embodiment, the swellable metal 810 may be mechanically compressed, and the binder 805 may be cast around the compressed swellable metal 810 in a desired shape. In some examples, additional non-swelling reinforcing agents may also be placed in the binder such as fibers, particles, or weaves.

It should be clearly understood that the examples illustrated by FIGS. 1-9 are merely general applications of the principles of this disclosure in practice, and a wide variety of other examples are possible. Therefore, the scope of this disclosure is not limited in any manner to the details of any of the FIGURES described herein.

It is also to be recognized that the disclosed sealing elements may also directly or indirectly affect the various downhole equipment and tools that may come into contact with the sealing elements during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are methods for forming a seal in a wellbore in accordance with the disclosure and the illustrated FIGURES. An example method comprises providing a swell packer comprising a swellable metal sealing element; wherein the swell packer is disposed on a conduit in the wellbore, exposing the swellable metal sealing element to a brine, and allowing or causing to allow the swellable metal sealing element to swell.

Additionally or alternatively, the method may include one or more of the following features individually or in combination. The swellable metal sealing element may comprise a metal, or metal alloy comprising a metal, selected from the group consisting of magnesium, calcium, aluminum, and any combination thereof. The swellable metal sealing element may swell to form the seal against a wall of the wellbore. The conduit may be a first conduit; wherein the swellable metal sealing element swells to form the seal between the first conduit and a second conduit. The swell packer may further comprise a swellable non-metal sealing element. The swell packer may further comprise a non-swelling reinforcement layer. The swellable metal sealing element may be disposed on the swell packer in at least two slats. The swellable metal sealing element may comprise a gap and wherein a line may be disposed within the gap. The conduit may comprise a profile variance on its exterior surface; wherein the swellable metal sealing element may be positioned over the profile variance. The swellable metal sealing element may comprise a binder. The swellable metal sealing element may comprise a metal oxide. The swell packer may be disposed in a wellbore zone having a temperature greater than 350° F.

Provided are swell packers for forming a seal in a wellbore in accordance with the disclosure and the illustrated FIGURES. An example swell packer comprises a swellable metal sealing element.

Additionally or alternatively, the swell packer may include one or more of the following features individually or in combination. The swellable metal sealing element may comprise a metal, or metal alloy comprising a metal, selected from the group consisting of magnesium, calcium, aluminum, and any combination thereof. The swellable metal sealing element may swell to form the seal against a wall of the wellbore. The swell packer may be disposed in a conduit. The conduit may be a first conduit; wherein the swellable metal sealing element swells to form the seal between the first conduit and a second conduit. The swell packer may further comprise a swellable non-metal sealing element. The swell packer may further comprise a non-swelling reinforcement layer. The swellable metal sealing element may be disposed on the swell packer in at least two slats. The swellable metal sealing element may comprise a gap and wherein a line may be disposed within the gap. The swellable metal sealing element may comprise a binder. The swellable metal sealing element may comprise a metal oxide. The swell packer may be disposed in a wellbore zone having a temperature greater than 350° F.

Provided are systems for forming a seal in a wellbore in accordance with the disclosure and the illustrated FIGURES. An example system comprises a swell packer comprising a swellable metal sealing element, and a conduit; wherein the swell packer is disposed on the conduit.

Additionally or alternatively, the system may include one or more of the following features individually or in combination. The swellable metal sealing element may comprise a metal, or metal alloy comprising a metal, selected from the group consisting of magnesium, calcium, aluminum, and any combination thereof. The swellable metal sealing element may swell to form the seal against a wall of the wellbore. The conduit may be a first conduit; wherein the swellable metal sealing element swells to form the seal between the first conduit and a second conduit. The swell packer may further comprise a swellable non-metal sealing element. The swell packer may further comprise a non-swelling reinforcement layer. The swellable metal sealing element may be disposed on the swell packer in at least two slats. The swellable metal sealing element may comprise a gap and wherein a line may be disposed within the gap. The conduit may comprise a profile variance on its exterior surface; wherein the swellable metal sealing element may be positioned over the profile variance. The swellable metal sealing element may comprise a binder. The swellable metal sealing element may comprise a metal oxide. The swell packer may be disposed in a wellbore zone having a temperature greater than 350° F.

EXAMPLES

The present disclosure may be better understood by reference to the following examples, which are offered by way of illustration. The present disclosure is not limited to the examples provided herein.

Example 1

Figure 10:
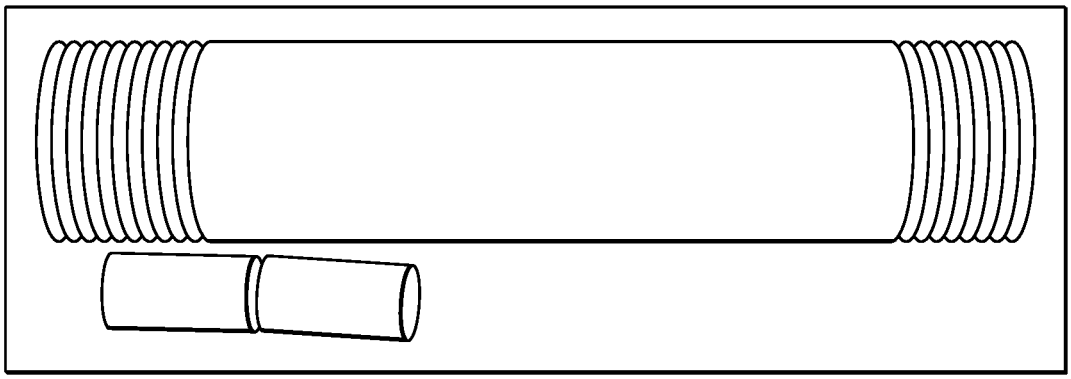
FIG. 10 is a photograph illustrating a top-down view of two sample swellable metal rods and a piece of tubing in accordance with the examples disclosed herein.
Figure 11:
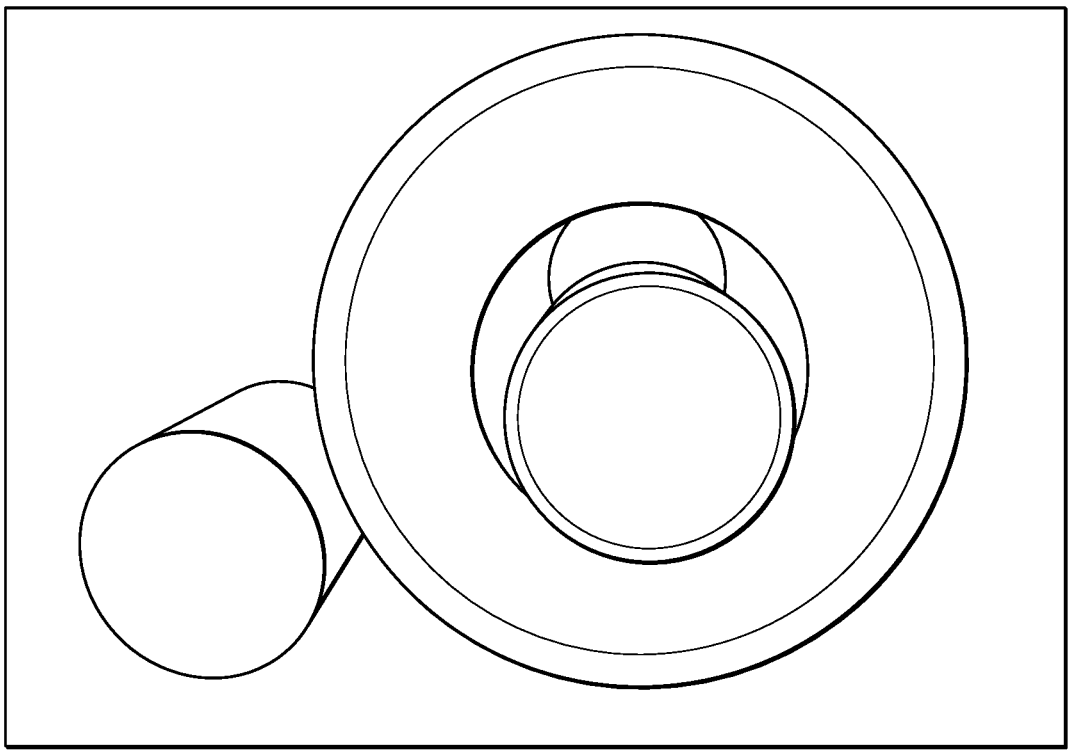
FIG. 11 is a photograph illustrating a side view of the sample swellable metal rod of FIG. 10 inserted into the piece of tubing and further illustrating the extrusion gap between the sample swellable metal rod and the piece of tubing in accordance with the examples disclosed herein.

Example 1 illustrates a proof-of-concept experiment to test the swelling of the swellable metal in the presence of a brine. An example swellable metal comprising a magnesium alloy created by a solid solution manufacturing process was prepared as a pair of 1" long metal rods having diameters of 0.5". The rods were placed into a piece of tubing having an inner diameter of 0.625". The rods were exposed to a 20% potassium chloride brine and allowed to swell. FIG. 10 is a photograph illustrating a top-down view of the two sample swellable metal rods and the piece of tubing. FIG. 11 is a photograph illustrating a side view of the sample swellable metal rod of FIG. 10 inserted into the piece of tubing and further illustrating the extrusion gap between the sample swellable metal rod and the piece of tubing.

Figure 12:
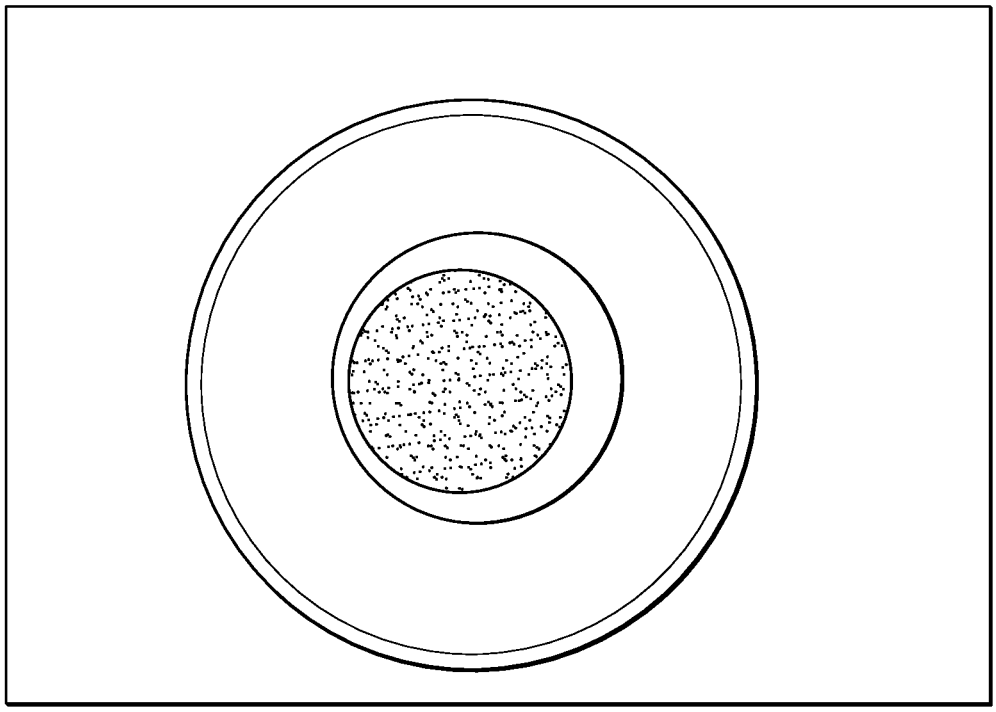
FIG. 12 is a photograph illustrating a side view of the swollen sample swellable metal rod of FIGS. 10 and 11 after sealing the piece of tubing in accordance with the examples disclosed herein.
Figure 13:
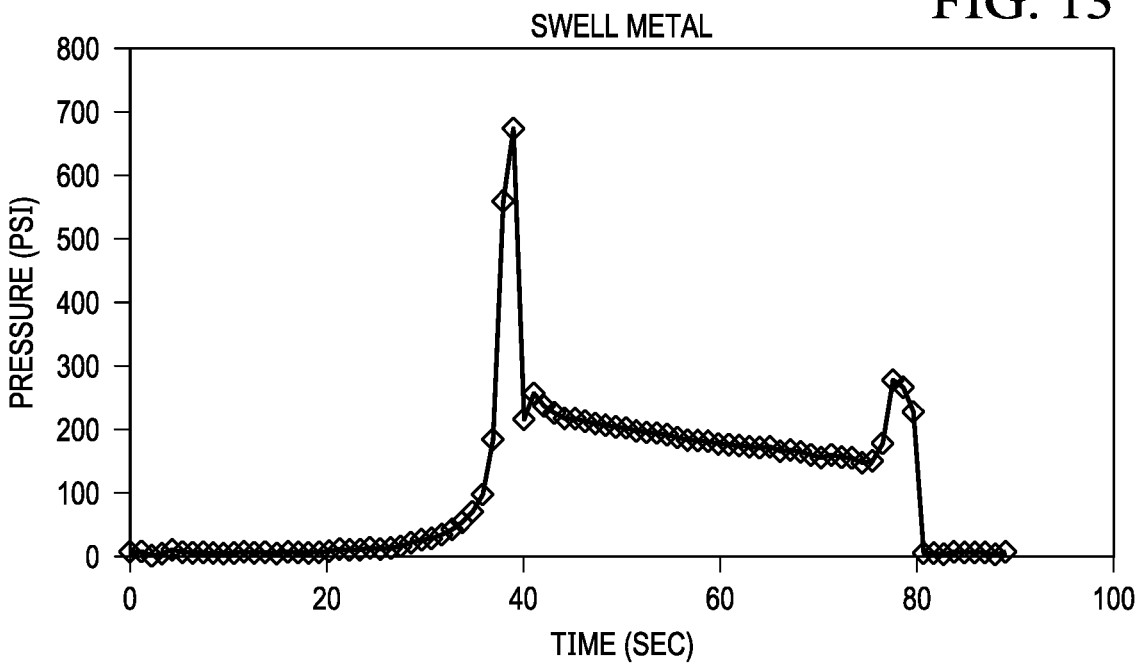
FIG. 13 is a graph charting pressure versus time for the portion of an experiment where the pressure was ramped up within the tubing of FIG. 12 to a sufficient pressure to dislodge the swollen metal rod from the tubing in accordance with the examples disclosed herein.

After swelling, the tubing sample held 300 psi of pressure without leakage. 600 psi of pressure was needed to force the swellable metal to shift in the tubing. As such, without any support the swellable metal was shown to form a seal in the tubing and hold 300 psi with a ⅛" extrusion gap. FIG. 12 is a photograph illustrating a side view of the swollen sample swellable metal rod of FIGS. 10 and 11 after sealing the piece of tubing. FIG. 13 is a graph charting pressure versus time for the portion of the experiment where the pressure was ramped up within the tubing of FIG. 12 to a sufficient pressure to dislodge the swollen metal rod from the tubing.

Figure 14:
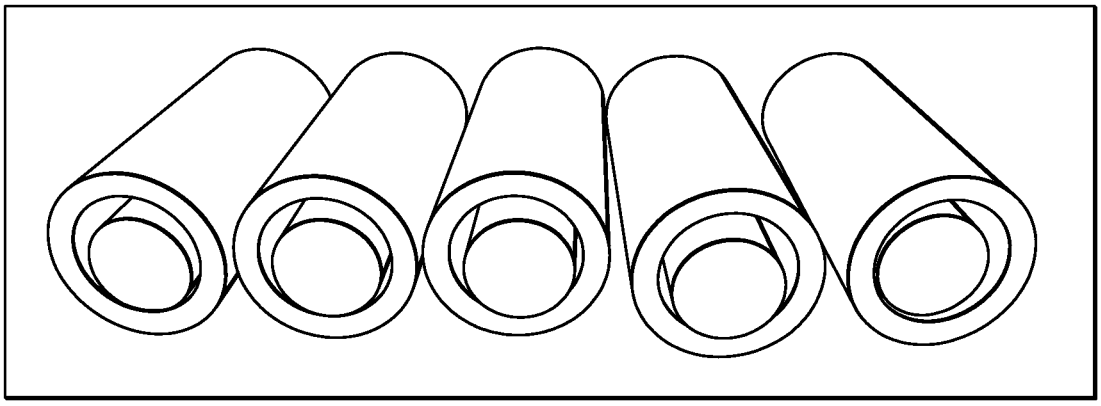
FIG. 14 is a photograph illustrating an isometric view of several sample metal rods disposed within sections of plastic tubing prior to swelling in accordance with the examples disclosed herein.
Figure 15:
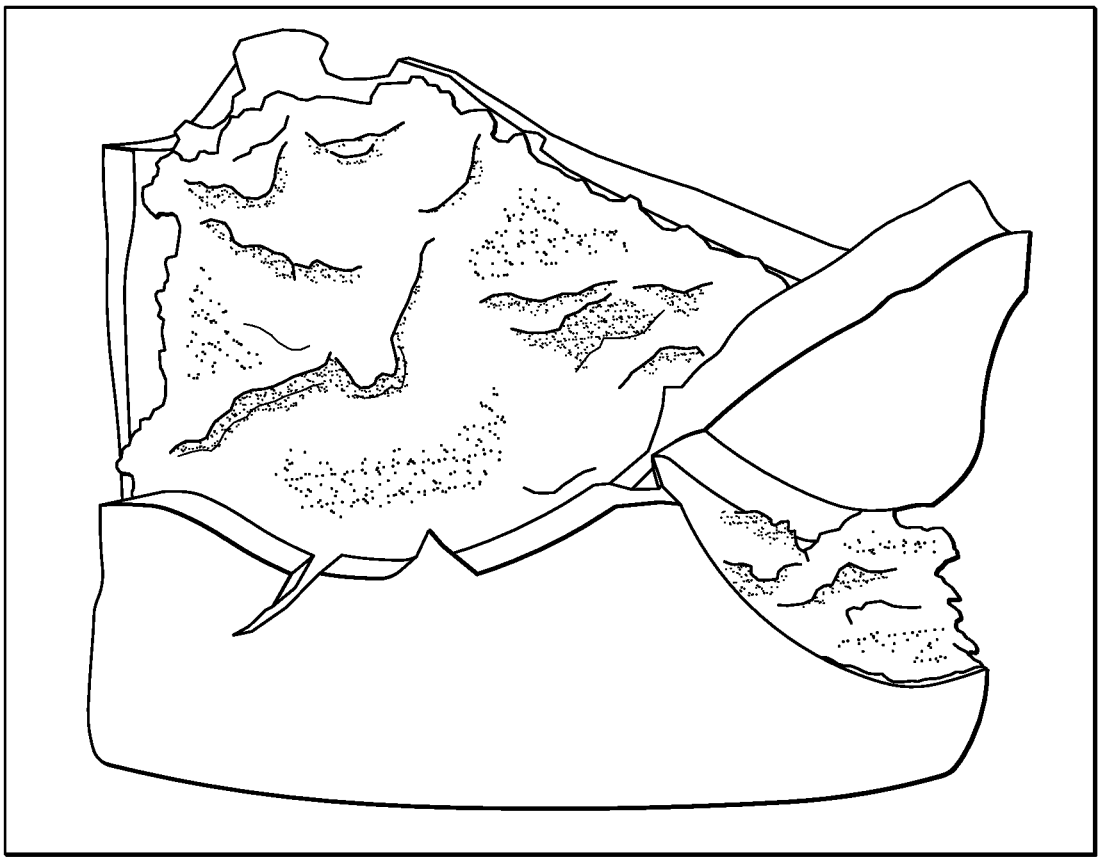
FIG. 15 is a photograph illustrating an isometric view of a swollen sample metal rod that has swollen to a sufficient degree to fracture the section of plastic tubing of FIG. 14 in accordance with the examples disclosed herein.

As a visual demonstration, the same metal rods were placed in PVC tubes, exposed to a 20% potassium chloride brine, and allowed to swell. The swellable metal fractured the PVC tubes. FIG. 14 is a photograph illustrating an isometric view of several sample metal rods disposed within sections of plastic tubing prior to swelling. FIG. 15 is a photograph illustrating an isometric view of a swollen sample metal rod that has swollen to a sufficient degree to fracture the section of plastic tubing of FIG. 14.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for forming a seal in a wellbore comprising:

providing a swell packer comprising a swellable metal sealing element having a first volume; wherein the swell packer is disposed on a conduit in the wellbore, wherein the swellable metal sealing element consists of a metal, metal alloy, or a combination thereof, exposing the swellable metal sealing element to a brine to irreversibly react the swellable metal sealing element with the brine to produce a metal hydroxide reaction product having a second volume greater than the first volume, and contacting a surface adjacent to the swellable metal sealing element with the metal hydroxide reaction product to form a permanent seal with the metal hydroxide reaction product.

2. The method of claim 1, wherein the metal or metal alloy comprises a metal selected from the group consisting of magnesium, calcium, aluminum, and any combination thereof.

3. The method of claim 1, wherein the adjacent surface is a wall of the wellbore.

4. The method of claim 1, wherein the conduit is a first conduit; wherein the swellable metal sealing element forms the seal between the first conduit and a second conduit.

5. The method of claim 1, wherein the swell packer further comprises a swellable non-metal sealing element.

6. The method of claim 1, wherein the swell packer further comprises a non-swelling reinforcement layer.

7. The method of claim 1, wherein the swellable metal sealing element is disposed on the swell packer in at least two slats.

8. The method of claim 1, wherein the swellable metal sealing element comprises a gap and wherein a line is disposed within the gap.

9. The method of claim 1, wherein the conduit comprises a profile variance on its exterior surface; wherein the swellable metal sealing element is positioned over the profile variance.

10. The method of claim 1, wherein the metal is a metal oxide.

11. The method of claim 1, wherein the swell packer is disposed in a wellbore zone having a temperature greater than 350° F.

12. A swell packer comprising:

a swellable metal sealing element consisting of a metal, metal alloy, or a combination thereof; wherein the swellable metal sealing element is configured to irreversibly react with a brine to form a metal hydroxide reaction product which forms a permanent seal with an adjacent surface.

13. The swell packer of claim 12, wherein the metal is selected from the group consisting of magnesium, calcium, aluminum, and any combination thereof.

14. The swell packer of claim 12, wherein the metal alloy comprises a metal selected from the group consisting of magnesium, calcium, aluminum, and any combination thereof.

15. The swell packer of claim 12, further comprising a swellable non-metal sealing element.

16. The swell packer of claim 12, further comprising a reinforcement layer.

17. A system for forming a seal in a wellbore:

a swell packer comprising a swellable metal sealing element consisting of a metal, metal alloy, or a combination thereof; wherein the swellable metal sealing element is configured to irreversibly react with a brine to form a metal hydroxide reaction product which forms a permanent seal with an adjacent surface, and a conduit; wherein the swell packer is disposed on the conduit.

18. The system of claim 17, wherein the swell packer further comprises a swellable non-metal sealing element.

19. The system of claim 17, wherein the conduit comprises a profile variance on its exterior surface; wherein the swellable metal sealing element is positioned over the profile variance.

20. The system of claim 17, wherein the metal selected from the group consisting of magnesium, calcium, aluminum, and any combination thereof.

* * * * *